United States Patent [19]

O'Day

[11] 4,219,177

[45] Aug. 26, 1980

[54] BED RAIL HANGER SYSTEM

[75] Inventor: David L. O'Day, Canoga Park, Calif.

[73] Assignee: American Hospital Supply Corporation, Evanston, Ill.

[21] Appl. No.: 936,875

[22] Filed: Aug. 25, 1978

[51] Int. Cl.[2] ..... E04G 3/00

[52] U.S. Cl. ..... 248/215; 128/295; 248/95; 248/311.2

[58] Field of Search ..... 248/214, 215, 340, 318, 248/95, 304, 311.1, 228; 128/275, 295; 24/230.5 AD, 230.5 R

[56] References Cited

U.S. PATENT DOCUMENTS

| | | | |
|---|---|---|---|
| 239,465 | 3/1881 | Delany | 248/304 |
| 2,261,511 | 11/1941 | Baker et al. | 248/95 |
| 2,869,812 | 1/1959 | Hamel | 248/304 X |
| 3,253,593 | 5/1966 | Cronin | 248/95 X |
| 3,371,900 | 3/1968 | Jacobs | 248/215 X |
| 3,529,598 | 9/1970 | Waldman | 248/95 X |
| 3,534,738 | 10/1970 | Huck | 248/95 X |
| 3,972,499 | 8/1976 | Simmons | 248/304 X |
| 4,019,707 | 4/1977 | Quinn et al. | 248/95 |
| 4,027,842 | 6/1977 | Mittleman | 248/215 X |
| 4,085,755 | 4/1978 | Burrage | 128/295 |

*Primary Examiner*—J. Franklin Foss

*Attorney, Agent, or Firm*—Larry N. Barger

[57] ABSTRACT

A hanger for securing a urinary drainage container to various sizes and shapes of bed rails. The hanger includes a hook with an inner lug which engages such rails and positions a container support that is connected to the hook.

6 Claims, 4 Drawing Figures

BED RAIL HANGER SYSTEM

BACKGROUND OF THE INVENTION

U.S. Pat. Nos. 2,959,386; 3,312,221; 3,345,023; and 4,019,707 all describe structures for mounting a urinary drainage bag to a bed rail. However, all of these patents have a disadvantage in that they have sections that very closely follow the bed rail's profile. Thus, they are not well suited for various shapes and sizes of bed rails. A bed rail often changes shape along its length, such as in a pivotal fold joint. An inverted L-shaped bed rail often takes on a different shape adjacent pivot joints in an adjustable bed. Sometimes it is desirable to position a urinary drainage container adjacent such pivot joints in the bed rail. Loop-type flexible hangers for securing a urinary drainage container to the bed rail are described in U.S. Pat. Nos. 3,231,901 and 3,537,109. These loop-type hangers have a disadvantage with some bed models in that they support the drainage container a significant distance below the bed rail. In low slung bed models, this can cause the drainage container to contact the floor and increase the possibility of contaminating the container.

As it is important to secure the drainage container as high on the bed rail as possible to avoid floor contact, an extremely large and loose fitting hook structure of perhaps 5 inch diameter to freely go over every bed rail is not practical.

SUMMARY OF THE INVENTION

The present invention provides a universal hook system for supporting a urinary drainage bag on a substantially wide variation of shapes and sizes of bed rails. The hook structure can support the drainage container in a high position relative to the bed rail, but is not required to closely follow the rail's contour. The hook is, therefore, not limited to a particular style, such as an inverted L-shaped bed rail. It can also very conveniently secure the bag to the rail at a thin strap section adjacent a bed rail's pivot joint.

THE DRAWINGS

DETAILED DESCRIPTION

Figure 1:
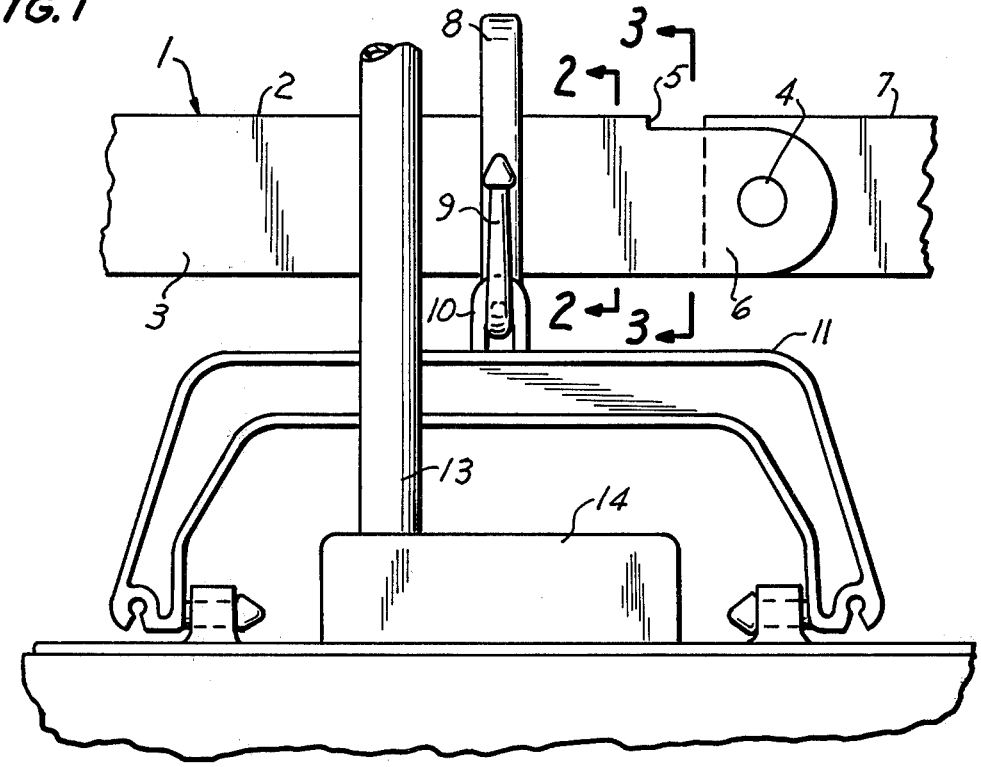
FIG. 1 is a fragmentary front elevational view of a drainage container secured to a bed rail.

FIG. 1 shows a section of a typical bed rail, which includes an inverted L-shaped member 1, with a top member 2 joined to a depending side member 3. Adjacent a pivot joint 4, top member 2 has been cut away in an area designated at 5 to provide a flat strap section 6 for the pivot. A second inverted L-shaped rail member 7 is also connected to pivot joint 4.

In most hospital beds, there are a plurality of pivot joints along each bed rail to provide many different angular positions of various portions of the bed. In some positions, it is desirable to hang a urinary drainage container at an inverted L-shaped section of the bed rail, as shown in FIG. 1. At other times, it is desirable to hang the container at a location adjacent to pivot joint, such as at thin strap member 6. This latter position is often desirable when the bed rail is in a V configuration with the pivot joint at the base of the V.

Securing the urinary drainage container at various locations along the bed rail is possible with the present invention, which includes a hanger with a hook 8 connected to a container support 9. This container support 9 is fitted through an eyelet 10 on a carrying handle 11 connected to a urinary drainage bag 12. Eyelet 10 is angularly disposed relative to carrying handle 11. A drain tube 13 can connect at its upper end to a urethral catheter (not shown) and to a drip chamber 14 at its lower end leading into bag 12.

Figure 2:
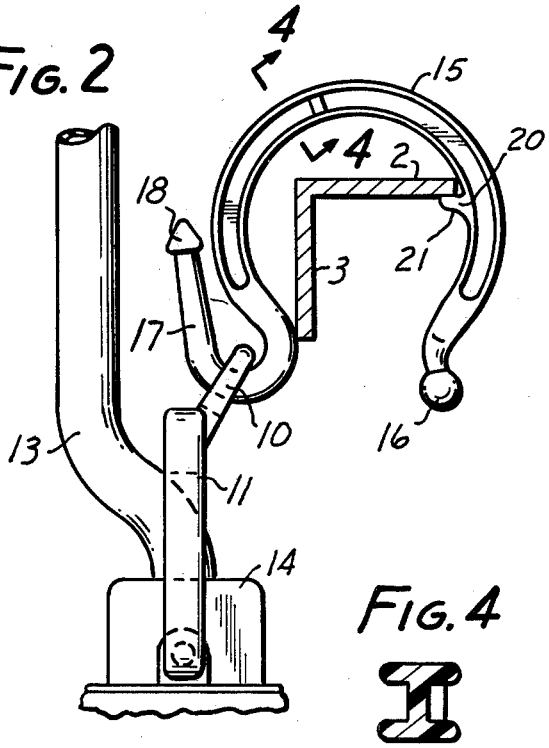
FIG. 2 is a sectional view taken along line 2—2 of FIG. 1.
Figure 4:
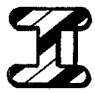
FIG. 4 is an enlarged sectional view taken along line 4—4 of FIG. 2.

The configuration of the hanger is more clearly shown in FIG. 2 where the hook includes an arcuate section 15 that terminates at an outer end in an enlarged grasping knob 16. The container support includes a reverse bight portion 17 that includes a knob 18 at its outer end. Preferably the arcuate portion 15 has portions which are generally I-shaped, as shown in FIG. 4, for high strength with reduced material requirements.

The arcuate section 15 of the hook includes a protruding lug 20 on its inner surface that has a shoulder surface abutting top member 2 of the bed rail and also has a cam surface 21 so that the hook can be easily rotated clockwise in FIG. 2 during assembly until the shoulder of lug 20 snaps under top member 2 of the bed rail. This elevates the container support 17 so it rides very high relative to the bed rail. It is understood that with smaller inverted L-shaped rails, the hook member would be rotated more toward the left. However, lug 20 would still prevent the hook from inadvertently sliding off the bed rail.

The position of the hook in FIG. 2 is the approximate position in which it is assembled to the drainage container. Preferably, eyelet 10 is laterally offset to provide easy threading of the container support 17 through eyelet 10. The knob 18 can have a generally conical arrowhead shape for easy assembly, but the hook can be removed from eyelet 10 with additional tugging effort, if desired. During shipment, the hanger can be swiveled about eyelet 10 for more compact packaging.

Figure 3:
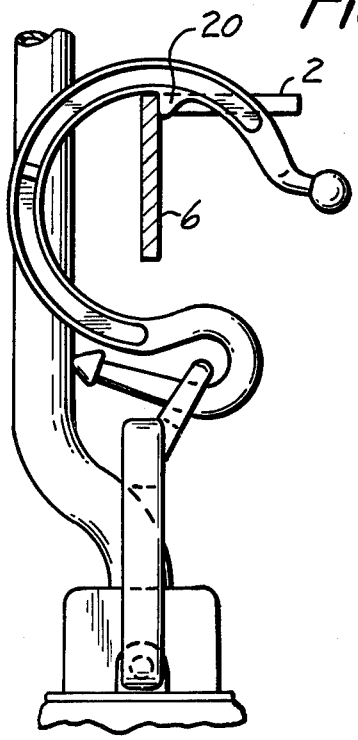
FIG. 3 is a sectional view taken along line 3—3 of FIG. 1.

When it is desired to hang the drainage container at a location shown in FIG. 3, lug 20 can engage strap member 6 and prevent inadvertent disengagement of the hook from the bed rail. Urinary drainage containers are particularly prone to become disengaged from the bed rail because they tend to swing as the bed is moved or the drainage container is inadvertently hit. This is apparently why the patents mentioned in the first paragraph of the specification required such close fitment to the bed rail, which limited their use to a particular shape, etc. of a bed rail. Applicant's invention does not have this restriction, but fits a wide range of shapes and sizes of bed rails.

In the foregoing description, a specific example has been used to describe the invention. However, it is understood by those skilled in the art that certain modifications can be made to the example without departing from the spirit and scope of the invention.

I claim:

1. A hanger and container combination comprising: a generally S-shaped hanger having a hook with an arcuate inner surface free of abrupt corners or grooves so as to slidingly engage rails of various configurations without substantial conformance to the rail's profile; an enlarged grasping knob on one end of the hook; a container support on an opposite end of the hook with a bight configuration reversed from the hook; a lug protruding from the arcuate inner surface of the hook, which lug has a shoulder surface for engaging a rail and a cam surface leading to this shoulder, said lug being adapted to maintain an angular position of the container support relative to such rail; and a medical container with a carrying handle having an eyelet angularly disposed relative to this handle, and the container support is coupled to the eyelet.

2. A hanger as set forth in claim 1, wherein the container support has an end with a retention knob.

3. A hanger as set forth in claim 1, wherein the hook is secured to a bed rail.

4. a hanger as set forth in claim 3, wherein the bed rail is generally L-shaped and oriented to provide a top member joined to a depending side member.

5. A hanger as set forth in claim 1, wherein the hook includes a stop means that engages the top member.

6. a hanger as set forth in claim 3, wherein the stop means is adapted to rotationally position the hook so as to elevate the container support when connected to a sufficiently large bed rail of an inverted L-shaped cross section.

* * * * *